US005980130A

United States Patent [19]

Earle et al.

[11] Patent Number: 5,980,130

[45] Date of Patent: Nov. 9, 1999

[54] RACK

[75] Inventors: Anthony Earle, Harrow Weald; Andrew J. Sewell, Watford, both of United Kingdom

[73] Assignee: Eastman Kodak Company, Rochester, N.Y.

[21] Appl. No.: 09/020,997

[22] Filed: Feb. 9, 1998

[30] Foreign Application Priority Data

Feb. 14, 1997 [GB] United Kingdom ..... 9703035

[51] Int. Cl.[6] ..... G03D 3/02

[52] U.S. Cl. ..... 396/626; 396/636

[58] Field of Search ..... 396/612, 620, 396/622, 626, 636, 641

[56] References Cited

U.S. PATENT DOCUMENTS

| | | | |
|---|---|---|---|
| 3,595,159 | 7/1971 | Bull | 396/626 |
| 4,775,873 | 10/1988 | Blackman et al. | 396/620 |
| 4,876,180 | 10/1989 | Abe et al. | 396/636 |
| 5,179,404 | 1/1993 | Bartell et al. | 396/617 |
| 5,309,191 | 5/1994 | Bartell et al. | 396/626 |
| 5,311,235 | 5/1994 | Piccinino, Jr. et al. | 396/626 |
| 5,339,131 | 8/1994 | Rosenburgh et al. | 396/626 |
| 5,361,114 | 11/1994 | Earle | 396/617 |
| 5,387,499 | 2/1995 | Earle et al. | 396/620 |
| 5,794,093 | 8/1998 | Kinoshita et al. | 396/636 |
| 5,835,811 | 11/1998 | Tsumura | 396/636 |

FOREIGN PATENT DOCUMENTS

| | | |
|---|---|---|
| 0 611 994 | 8/1994 | European Pat. Off. . |
| 0 829 762 | 3/1998 | European Pat. Off. . |
| 2310508 | 8/1997 | United Kingdom . |

OTHER PUBLICATIONS

Patent Abstracts of Japan, 05 066541 A, vol. 17, No. 390 (p–1577), Jul. 21, 1993 Fuji Photo Film Co., Ltd., Mar. 19, 1993.

*Primary Examiner*—D. Rutledge
*Attorney, Agent, or Firm*—Frank Pincelli

[57] ABSTRACT

A rack for use in a low volume thin tank of a photosensitive web processing apparatus. The rack comprises a plurality of fluid circulation ports in a face of the rack for applying fluid to a photosensitive web during processing. The fluid circulation ports are arranged, in use, to discharge fluid into and withdraw fluid from the tank in which the rack is situated. The rack has a textured surface structure over which the fluid passes in use to provide agitation of the fluid in the tank. Improved processing of the photosensitive web can result, thereby also reducing the time taken to process the web. Additionally, the rack may be modular in construction, thereby facilitating the installation of the rack into the tank of the processing apparatus.

15 Claims, 4 Drawing Sheets

RACK

FIELD OF THE INVENTION

This invention relates to racks, and in particular to racks for use in a low volume thin tank of a photographic processing apparatus.

BACKGROUND OF THE INVENTION

Large wholesale processing machines which process photographically sensitized webs are well known. These machines can run at speeds of up to 50 meters per minute depending on the number of tanks through which the web must pass to be processed. Further, such machines can be sufficiently wide to accommodate up to 6 separate webs moving in parallel through the machine. Most of these machines are individually configured from standard components to suit individual laboratory requirements.

Recent developments have shown that the chemical volume of the prior art large volume tank processing machines described above can be reduced by up to 90% by including a volume filling rack within each tank. Such a low volume thin tank (LVTT) type apparatus is disclosed in U.S. Pat. Nos. 5,179,404; 5,311,235; 5,309,191; 5,339,131 and 5,387,499. A limit to the maximum practical volume reduction is the space needed for the reliable transport of the webs through the tanks and the efficient recirculation and/or replacement of the chemicals used in the tanks.

As a result of reducing the volumes of tanks in a processing apparatus, new chemical formulations (such as Redox Amplification (RX) formulations) can be used which shorten the time of the various processing steps occurring in the tanks, thereby leading to increases in the line speed of the processing apparatus.

Although the new chemical formulations mentioned above can result in faster development of a photographically sensitized web, efficient usage of the chemicals relies on the chemicals being rapidly brought into contact with the sensitized web and then being quickly removed and replaced by fresh chemicals when the chemicals become exhausted. This action is normally known as agitation. In small machines a chemical recirculation pump is used to provide the agitation by quickly turning the tank contents around at anything up to about 12 times per minute. In the large wholesale machines, however, which hold about 250 liters per tank in an LVTT-type apparatus, the pump size required to obtain sufficient agitation (i.e. chemical replacement) becomes excessive.

With the foregoing in mind, the present invention aims to provide an improved rack for use in a low volume thin tank processing apparatus which assists in overcoming the problem highlighted above.

SUMMARY OF THE INVENTION

According to the present invention, there is provided a rack for use in a low volume thin tank of a photosensitive web processing apparatus. The rack comprises a plurality of fluid circulation ports in a face of the rack for applying fluid to a photosensitive web during processing, wherein the fluid circulation ports are arranged, in use, to discharge fluid into and withdraw fluid from a tank in which the rack is situated and wherein the rack has a textured surface structure over which the fluid passes in use to provide agitation of the fluid in the tank.

In the past, fluid containing the required chemicals has generally been added to a tank towards the top of the tank possibly via the rack, and simply withdrawn from the tank through an outlet at the bottom of the tank. By using a rack according to the present invention, the chemicals can be applied to and withdrawn from the tank in a much more efficient and controlled manner, thereby providing uniform sensitometry throughout a roll of web being processed.

Preferably, the fluid circulation ports and the textured surface structure each extend across substantially the full width of the web, thereby assisting in providing a uniform application of chemicals to the full width of the web. In such an embodiment chemicals discharged from the circulation ports flow in the longitudinal direction of the web, either in the direction of or against the direction of the web.

In a preferred embodiment, the circulation ports for discharging fluid are elongate slots. This configuration has been found to result in improved uniform application of chemicals to the web without producing "trails", which can occur if a series of small holes are used.

The circulation ports for withdrawing fluid from a tank may comprise a line of apertures, conveniently holes, or a single slot. As a result, a more uniform withdrawal of fluid from across the width of the web can be achieved.

The circulation ports preferably each extend substantially perpendicularly to the longitudinal direction of the web.

In a particular embodiment, at least two pairs of circulation ports are included on each face of the rack. Clearly, however, if the rack is long, more pairs of circulation ports may be required and included.

The rack surface has a textured surface to encourage turbulence in the flow of fluid. This surface may comprise, for example, a slotted surface, pyramids or a random surface, such as coarse leather or grain granules or any other flow-disturbing surface.

According to another aspect of the present invention there is provided a photographic apparatus for processing a photosensitive material, comprising at least one processing section having a low volume thin tank, a rack for inserting within the tank, the tank and rack defining a narrow processing channel therebetween, the rack being as herein described.

According to a further aspect of the present invention there is provided a rack for use in a low volume thin tank of a photosensitive web processing apparatus, wherein the rack is modular. As a result, racks of different sizes can be erected from a number of different standard rack modules.

Preferably the rack can be assembled in situ in a tank of a processing apparatus, thereby avoiding any need to lift the complete rack, which can be extremely heavy, into the tank.

In a particular embodiment, the rack comprises a frame including guide means, preferably rollers, for the photosensitive web.

Preferably the rack comprises a plurality of modular panels, especially 2 to 6 panels, which, in use, are received by and locked to the frame. In practice probably only the top panel will be locked to the frame since, by locking the top panel, the remaining panels will be held in position.

In a specific embodiment, the rack comprises three modular panels.

Preferably fluid inlet and outlet ports are provided in the frame for alignment with corresponding inlet and outlet ports in the modular panels. As a result, chemicals can be applied via the rack to a photosensitive web passing through the processing apparatus.

In a particular embodiment, the frame may include means for locking the rack in a tank of a processing apparatus. This may be important if the rack is manufactured from a buoyant material, since the rack must remain in situ in the tank during use.

These rack modules include the textured surface structure, which helps to agitate the fluid in the tank during use, as well as including the fluid ports.

The rack may be manufactured using structural foam PVC sheets, fiber composite materials (such as glass fiber in resin) or any other appropriate lightweight material. If the rack is manufactured using structural foam sheets which are molded with closed cells, the sheets may be machined to provide a surface structure. Indeed, racks manufactured in this way have proved to have surprisingly good agitation properties.

According to another aspect of the present invention, there is provided a method of placing a rack into a low volume thin tank, the rack comprising a frame, a plurality of modular removable sections and means for locking at least one of the modular removable sections to the frame, the method comprising the steps of:

placing the frame and at least one of the modular sections into the tank;

lowering additional modular sections in succession onto the at least one modular section; and locking the uppermost modular section to the rack to retain the modular sections in position in the tank.

BRIEF DESCRIPTION OF THE DRAWINGS

Specific embodiments of the present invention are now described, by way of example only, with reference to the accompanying drawings, in which.

DETAILED DESCRIPTION OF THE INVENTION

Figure 1:
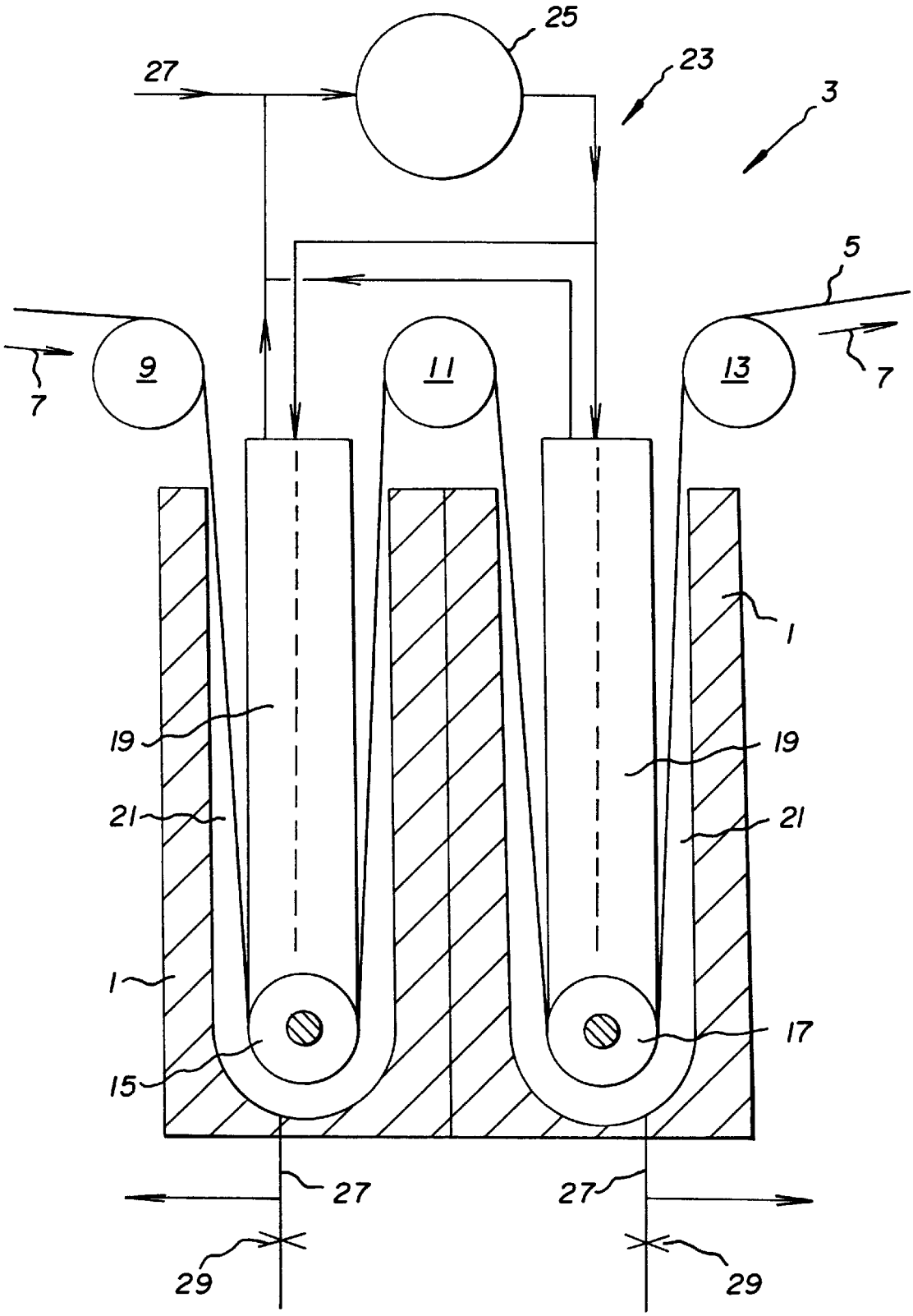
FIG. 1 shows a schematic representation of two low volume thin tanks of a photosensitive web processing apparatus.

With reference to FIG. 1 of the drawings, two tanks 1 of a low volume thin tank (LVTT) processing apparatus 3 are shown. The number of tanks 1 to be employed depends upon the number of chemical formulations and washes required to process correctly a photographically sensitized web 5 passing through the apparatus 3.

As can be seen, the web 5 passes through each tank 1 in the direction of arrows 7. Upper rollers 9, 11, 13 guide the web 5 between the tanks 1 and lower rollers 15, 17 guide the web 5 within the tanks 1. The lower rollers 15, 17 are supported at the bottom of each rack 19 which fills a significant portion of each tank 1, thereby resulting in the tanks 1 containing only a low volume of fluid in a small thin processing channel 21. It is through this small thin channel 21 that the web 5 passes during its treatment.

FIG. 1 also shows a basic plumbing system 23 including a pump 25 for providing chemical solutions to the channel 21 via the racks 19. A bottom outlet 27 is also provided from each tank I through which fluid can be either recirculated via pump 25 back into the tank 1 or allowed to drain out of the system via valve 29.

Figure 2:
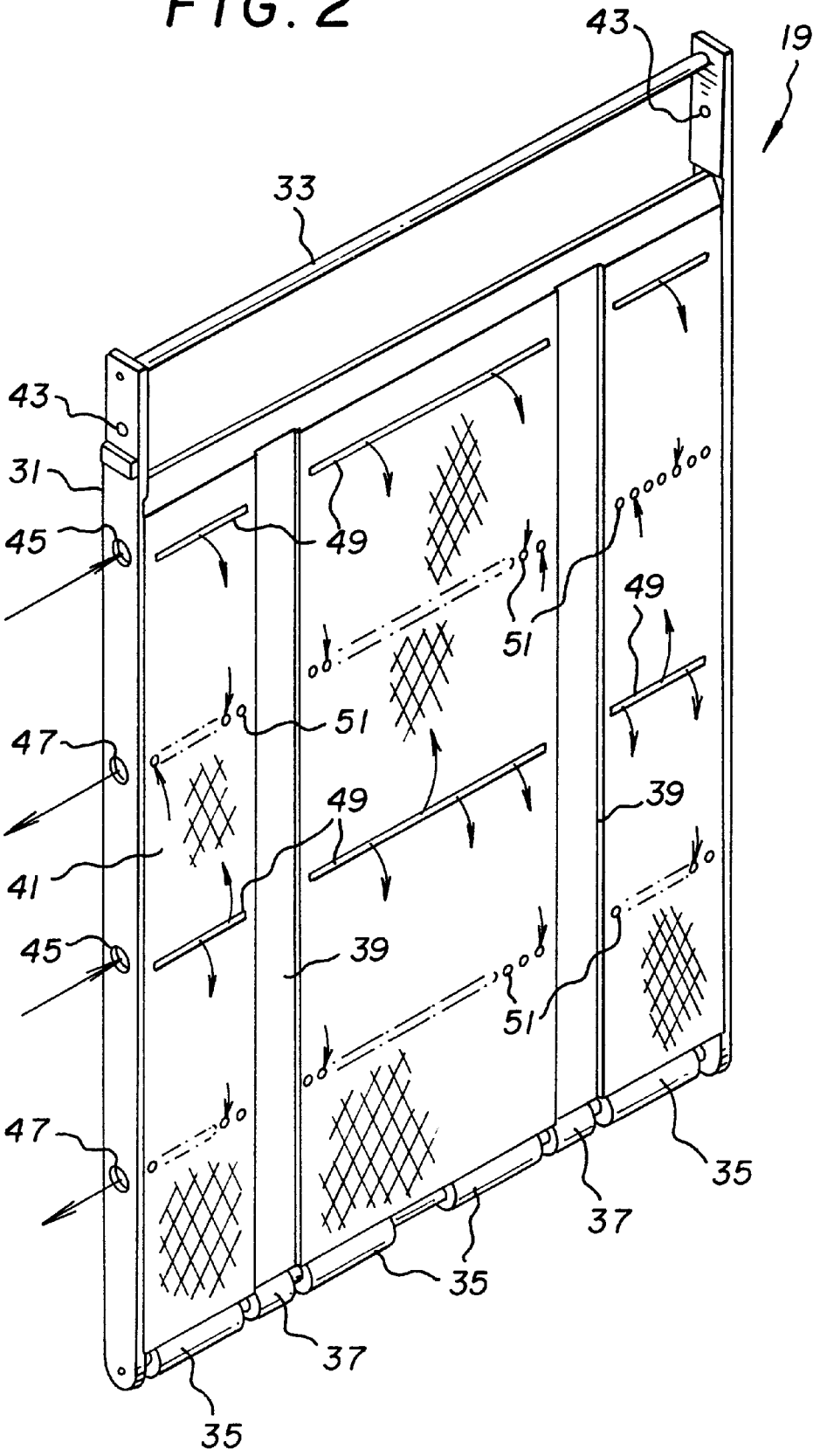
FIG. 2 is a perspective view of a first embodiment of rack according to the present invention for use in the apparatus shown in FIG. 1.

Turning now to FIG. 2 of the drawings, a first embodiment of rack 19 according to the present invention is shown. The rack 19, which is made primarily of a plastic material, such as laminated structural foam PVC sheets or fiber composite material, comprises a frame 31 carrying a handle 33 and a plurality of rollers 35 for guiding the photographically sensitized web 5 during use of the rack 19. In this embodiment, the rack is shown with four rollers 35 for the webs 5. More or less rollers 35 could, however, be used in other embodiments. Guide rollers 37 are also included for guiding a continuous drive belt (not shown) of the processing apparatus 3. Grooves 39 are also included (in this embodiment) in each face 41 of the rack 19 to accommodate the drive belt and a clip (not shown) for attaching a web 5 to the drive belt.

In use, the rack 19 slides into a tank 1 of a processing apparatus 3 and is held in position by means of a locking device (not shown) which engages locking apertures 43 in the upper end of the frame 31. Compliant collars (not shown) sealed to inlets 45 and outlets 47 in the frame 31 of the rack 19 also engage corresponding apertures in the walls of the tank 1 to position the rack 19 within the tank 1.

The pump 25 drives processing solutions into the inlets 45 such that the solutions exit from supply slots 49 in each face 41 of the rack 19 into contact with photographically sensitized webs 5 passing through the tanks 1. The supply slots 49 provide a relatively uniform application of the processing solutions and the sweeping action of the webs 5 across the supply slots 49 helps to ensure that the webs 5 are processed evenly.

The processing solution is encouraged to tumble downwards (and upwards to a certain extent) toward a line of apertures 51 through which the solution can be sucked away via outlets 47 either for recirculation through pump 25 or to a drain. This action of continually applying processing solution through slots 49 across the surface structure and withdrawing the solution through apertures 51 helps to improve the agitation of the chemicals in contact with the photographically sensitized webs 5, thereby producing a more efficient processing apparatus 3.

Figure 4:
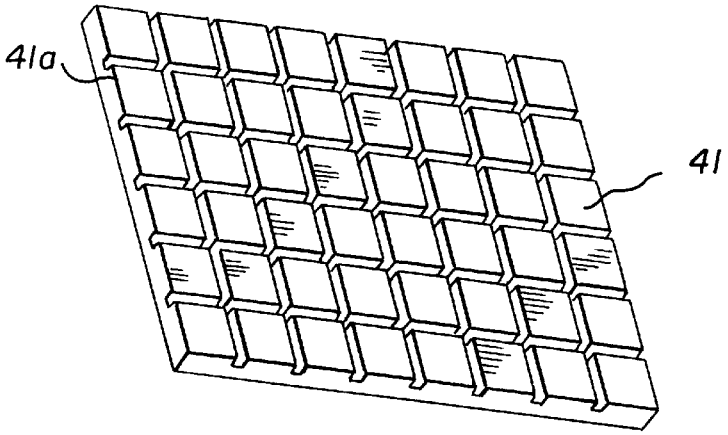
FIGS. 4, 5 and 6 are schematic illustrations of textured surfaces which can be used for the rack surface shown in FIGS. 2 and 3.
Figure 5:
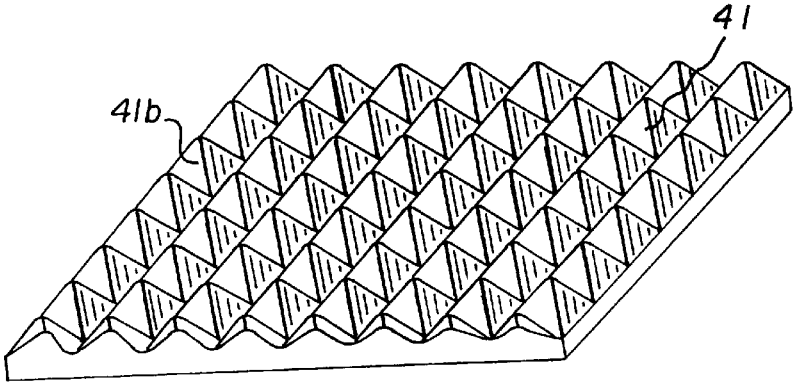
Figure 6:
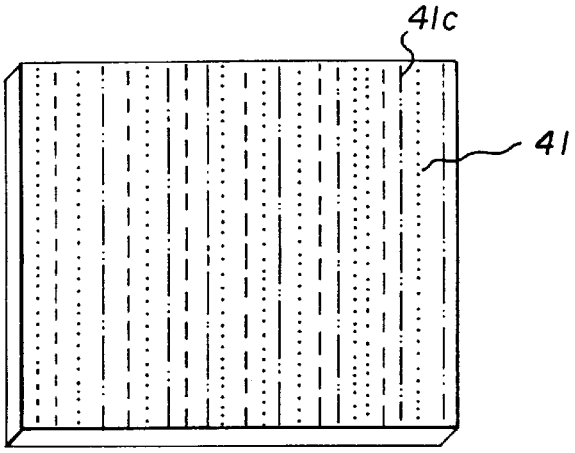

It should be noted that the surface 41 of the rack 19 also plays an essential part in the agitation process. By having a textured surface structure which allows the processing solutions to flow between the rack face 41 and the web 5 in a turbulent and chaotic manner, improved agitation results. The nature and dimensions of this textured surface structure depend on the viscosity of the processing solution, but it has been found that, in a developing tank 1, a rack 19 which is manufactured using structural foam PVC sheets machined to expose the closed cells of the sheets results in a rack 19 having excellent agitation properties. Other forms of textured surface structure may, of course, alternatively be used. For example, a slotted surface 41*a* having slots about 0.5 mm wide×0.5 mm deep×2.5 mm spacing in a grid pattern could be used, as shown in FIG. 4. Further, a surface structure comprising a plurality of pyramids 41*b* about 3 mm×3 mm×2.5 mm high may also be used, as shown in FIG. 5. A random surface 41*c*, like coarse leather or grain granules, is another alternative, as shown in FIG. 6.

Figure 3:
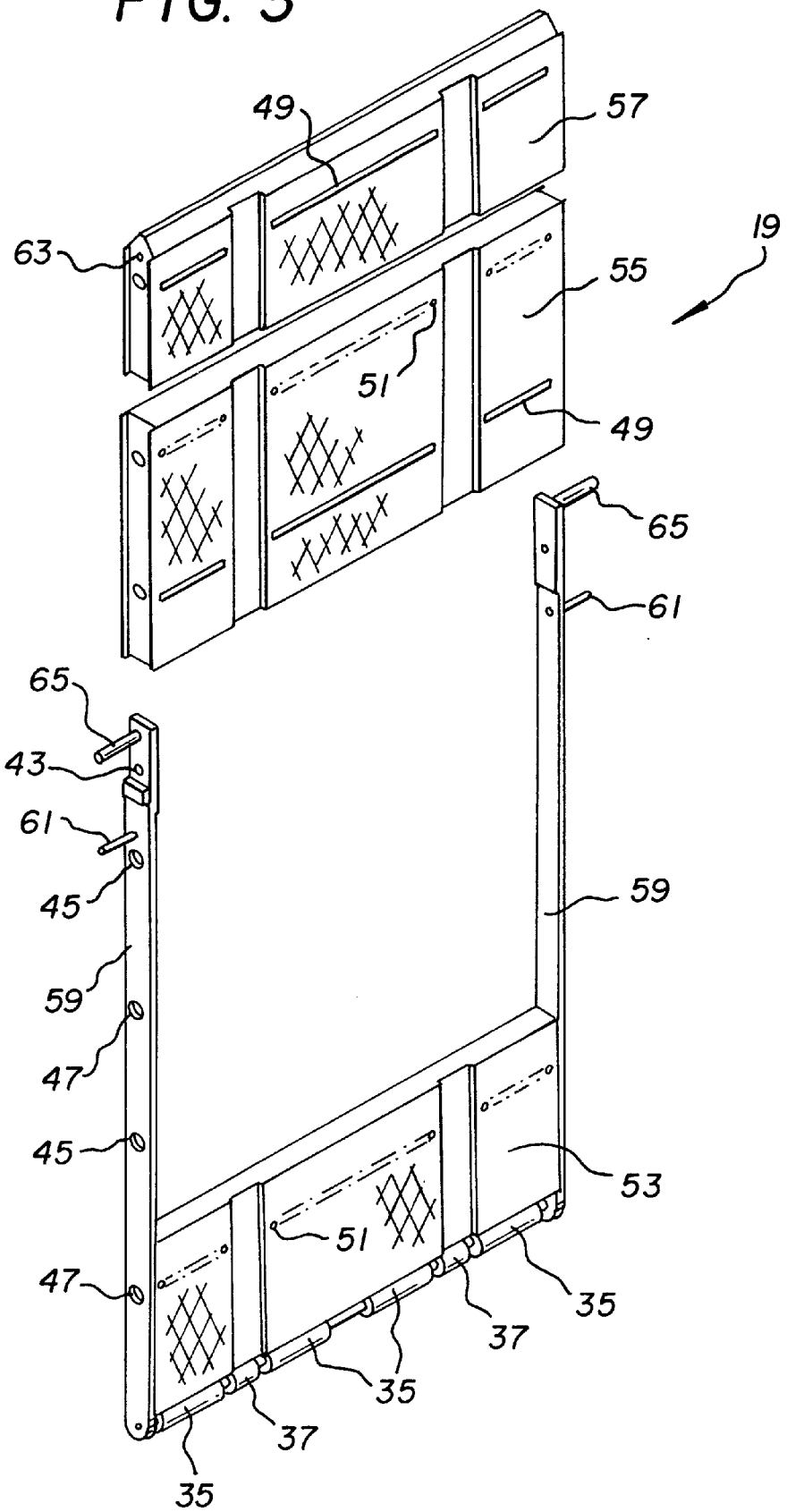
FIG. 3 is a perspective view of a second embodiment of rack according to the present invention in which modular parts are separated.

With reference to FIG. 3 of the drawings, a second embodiment of rack 19 according to the present invention is shown. In this embodiment, however, the rack 19 is modular and comprises a first rack section 53, a second rack section 55 and a third rack section 57. Side rails 59 support web rollers 35 and drive rollers 37 and are preferably formed integrally with the first rack section 53 to provide a rigid structure. This rigid structure can be readily inserted into a tank 1 of a low volume thin tank processing apparatus. The first rack section 53 is held in position by means of a locking device (not shown) which engages locking apertures 43 in the upper end of the side rails 59. The second rack section 55 and third rack section 57 can subsequently be slid down the rails 59 into position adjacent the first rack section 53, thereby completing the rack 19 and avoiding any need to lift the complete rack 19, which is typically 1 meter high, into position.

To hold the second and third rack sections 55,57 in position, a detent or locking device 61 acts between the rails 59 and the third rack section 57. In the specific embodiment shown in FIG. 3, the locking device is a sliding pin 61 which, when the third rack section 57 is in position, can be moved to engage a recess or hole 63 in the third rack section 57. The third rack section 57 is then held in position with the second rack section 55 sandwiched between the first rack section 53 and the third section 57.

It is important to hold the rack sections 55,57 in position, especially if they are manufactured from a buoyant material, such as a fiber composite, since otherwise they may tend to rise up and out of the tank 1. Furthermore, the side rails 59 include outward projections 65 which form lifting handles.

Each of the rack sections 53, 55, 57 are provided with supply slots 49 and/or drain holes 51 as necessary, so that a complete rack 19 as shown in FIG. 2 can be assembled. In another embodiment, however, a different combination of rack sections could be used to provide a rack 19 of different length or a rack 19 in which the flow of processing solutions across the faces of the rack 19 is different. In any event, appropriate inlets 45 and outlets 47 are provided in the side rails 59 to enable processing solutions to be supplied to the rack 19.

As will be appreciated, a modular rack 19 as shown in FIG. 3 (i) reduces the maximum weight to be lifted each time the rack 19 is to be entered into or removed from a tank 1, (ii) reduces the size of the tool needed to manufacture the rack 19, thereby easing the manufacturing tolerances, and (iii) enables replacement of individual rack sections to occur, when necessary.

The processing apparatus as hereinbefore described is of the low volume thin tank type. That is, a relatively small amount of processing solution is allowed in the processing channel 21 and the recirculation system 23, 27. This is accomplished by providing a relatively narrow processing channel 21 and by minimizing the amount of processing solution passing through the recirculation system 23, 27. For the purposes of the present invention, a low volume thin tank processor is a processor wherein the ratio of the total volume of processing solution to the product of the maximum width of photographic material processed and the path length taken by the photographic material through the processing solution within the tank, is less than about 25 $dm/mm^2$. Preferably this ratio is less than about 11 $dm/mm^2$ and most preferably less than about 3 $dm/mm^2$.

The total volume of processing solution or 'tank volume' is defined as the volume of the solution within the processing tank/channel of a processing stage together with that of the associated recirculation system, which includes, for example, pipework, valves, pumps, filter housings etc.

The volume of the processing solution actually within the processing channel 21 is preferably such that it comprises at least 40% out of the total processing solution available in the processing channel 21 and recirculation system 23, 27. Preferably this ratio is at least 50%.

It will of course be understood that the present invention has been described above purely by way of example, and that modifications of detail can be made within the scope of the invention.

What is claimed is:

1. A rack for use in a low volume thin tank of a photosensitive web processing apparatus, the rack comprising:

a guide frame, including guide means for the photosensitive web, a plurality of modular removable sections and means for locking at least one of the modular removable sections to the frame;

a plurality of fluid circulation ports in a face of the rack for applying fluid to a photosensitive web during processing, wherein the fluid circulation ports are arranged, in use, to discharge fluid into and withdraw fluid from a tank in which the rack is situated, and wherein the rack has a textured surface structure over which the fluid passes in use to provide agitation of the fluid in the tank.

2. A rack as claimed in claim 1, wherein the fluid circulation ports are arranged such that, in use, fluid discharged from the ports flows in a longitudinal direction of the web.

3. A rack as claimed in claim 1, wherein the circulation ports for discharging fluid are elongate slots.

4. A rack as claimed in claim 1, wherein the circulation ports for withdrawing fluid each comprise a line of apertures.

5. A rack as claimed in claim 1, wherein the circulation ports each extend substantially perpendicularly to a longitudinal direction of the web.

6. A rack as claimed in claim 1, wherein at least two pairs of said circulation ports are included on each face of the rack.

7. A rack as claimed in claim 1, wherein the guide means are rollers.

8. A rack as claimed in claim 1, wherein the rack comprises three of said sections.

9. A rack as claimed in claim 1, wherein fluid inlets and outlets are provided in the frame for alignment with corresponding inlets and outlets in the modular sections.

10. A rack as claimed in claim 1, wherein the frame includes means for locking the rack in a tank of a processing apparatus.

11. A rack as claimed in claim 1, wherein the surface structure is provided by a plurality of pyramids.

12. A method of placing a rack into a low volume thin tank, the rack comprising a frame, a plurality of modular removable sections and means for locking at least one of the modular removable sections to the frame, the method comprising the steps of:

placing the frame and at least one of the modular sections into the tank;

lowering additional modular sections in succession on to the at least one modular section; and locking the uppermost modular section to the rack to retain the modular sections in position in the tank.

13. A photographic apparatus for processing a photosensitive material, the apparatus comprising:

at least one processing section having a low volume thin tank, and a rack for insertion within the tank, the tank and rack defining a narrow processing channel therebetween, the rack comprising a frame, including guide means for the photosensitive web, a plurality of modular removable sections and means for locking at least one of the modular removable sections to the frame; a plurality of fluid circulation ports in a face of the rack for applying fluid to a photosensitive web during processing, wherein the fluid circulation ports are arranged, in use, to discharge fluid into and withdraw fluid from the tank in which the rack is situated and wherein the rack has a textured surface structure over which the fluid passes in use to provide agitation of the fluid in the tank.

14. A rack for use in a low volume thin tank of a photosensitive web processing apparatus, the rack comprising:

a frame, a plurality of modular removable sections and means for locking at least one of the modular removable sections to the frame, a plurality of fluid circulation ports in a face of the rack for applying fluid to a photosensitive web during processing, wherein the fluid circulation ports are arranged, in use, to discharge fluid into and withdraw fluid from a tank in which the rack is situated, and wherein the rack has a textured surface structure over which the fluid passes in use to provide agitation of the fluid in the tank, said rack being made of a light weight fiber composite material.

15. A rack for use in a low volume thin tank of a photosensitive web processing apparatus, the rack comprising:

a plurality of fluid circulation ports in a face of the rack for applying fluid to a photosensitive web during processing, wherein the fluid circulation ports are arranged, in use, to discharge fluid into and withdraw fluid from a tank in which the rack is situated, and wherein the rack has a textured surface over which the fluid passes in use to provide agitation of the fluid in tank, wherein said rack further comprises a frame, a plurality of removable modular sections, and means for locking at least one of the modular removable sections to the frame.

* * * * *